United States Patent [19]

Kehr

[11] Patent Number: 4,669,145

[45] Date of Patent: Jun. 2, 1987

[54] HOSE REEL SYSTEM

[76] Inventor: Edwin A. Kehr, Rte. 1, Box 1161, Bartow, Fla. 33830

[21] Appl. No.: 780,082

[22] Filed: Sep. 25, 1985

[51] Int. Cl.[4] ..... B08B 3/02

[52] U.S. Cl. ..... 15/302; 15/315; 134/166 C; 134/169 C; 239/198; 242/86.2; 254/415

[58] Field of Search ..... 15/302, 315; 239/195, 239/197–199; 242/86, 86.2; 254/395, 415; 134/166 C, 167 C, 168 C, 169 C

[56] References Cited

U.S. PATENT DOCUMENTS

| | | | |
|---|---|---|---|
| 2,312,528 | 3/1943 | Davis | 242/86 X |
| 2,802,639 | 8/1957 | Troyer | 254/395 X |
| 2,896,659 | 7/1959 | Erickson | 242/86 X |
| 3,625,450 | 12/1971 | Lloyd | 242/86 |
| 3,753,409 | 8/1973 | Frazier | 239/198 X |
| 4,066,093 | 1/1978 | Egerstrom | 242/86.2 X |
| 4,199,837 | 4/1980 | Fisco | 15/302 |
| 4,246,675 | 1/1981 | Costanzo | 242/86 X |
| 4,322,868 | 4/1982 | Wurster | 15/302 |

*Primary Examiner*—Chris K. Moore

*Attorney, Agent, or Firm*—Macdonald J. Wiggins

[57] ABSTRACT

A hose reel system for a sewer and catch basin cleaner and the like has a fixed mounted hose reel and a movable hose traction wheel. The hose reel includes a drive motor which rotates the reel in a direction to wind a hose onto the reel and a clutch which permits the reel to freely rotate when the hose is payed out. The hose traction wheel may be attached to a boom movable horizontally and vertically with respect to the reel and is driven by a motor to pay out the hose and a clutch which permits the traction wheel to turn freely during rewind of the hose. A first fairlead assembly mounted to the fixed reel and a second fairlead assembly mounted to the hose traction wheel guides the hose to permit pay out and rewind when the traction wheel is not in the plane of the reel.

11 Claims, 9 Drawing Figures

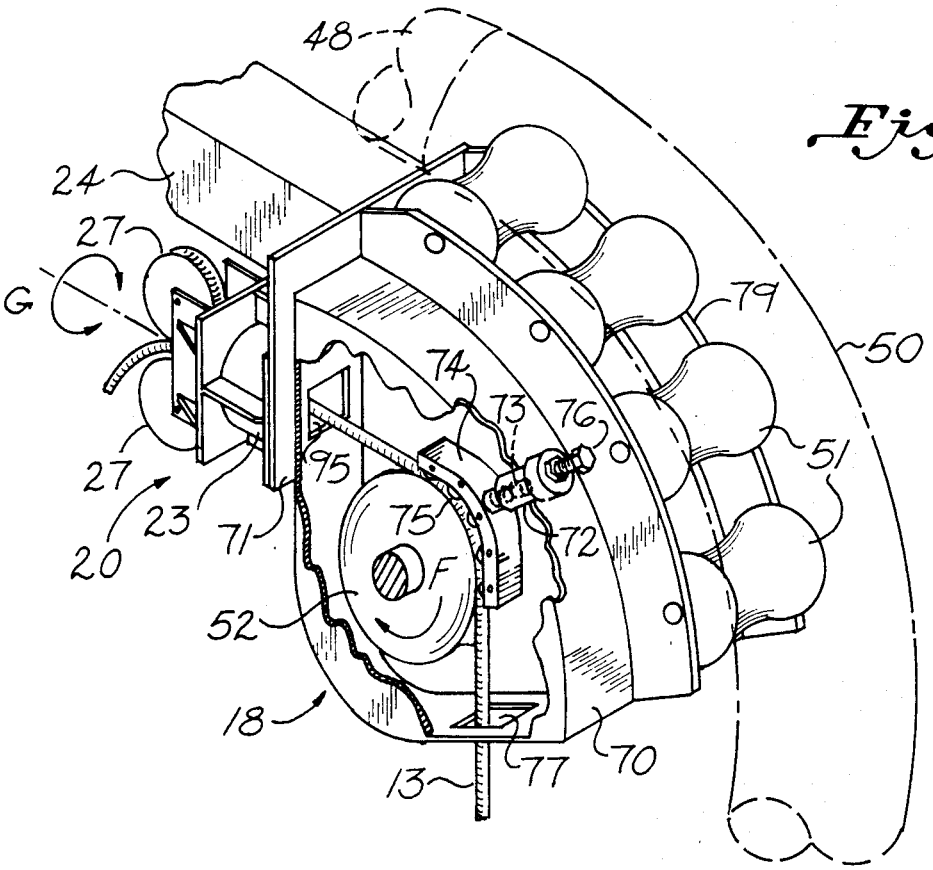
Fig. 5
Fig. 6
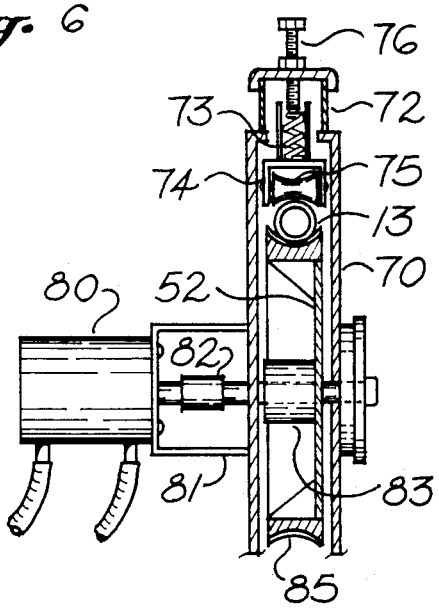

30
24
12
13
22
20
52
13a
13b

HOSE REEL SYSTEM

BACKGROUND OF THE INVENTION

1. Field of the Invention

The present invention relates generally to hose reel systems, and more particularly to a hose reel system in which there is horizontal and vertical displacement of the hose during payout and retrieval thereof.

2. Description of the Prior Art

The present invention is particularly applicable to sewer and catch basin cleaner systems which utilize a high pressure hose which is inserted into sewer laterals for dislodging debris and having a large diameter suction hose for removing the debris from a catch basin. U.S. Pat. No. 4,134,174 to Flynn et al provides a description of a typical sewer and catch basin cleaner in the prior art. A truck is provided with a water tank and a water pump. The tank has an outlet into a hose reel mounted to the truck and hose. The water hose is supported by a boom to allow the hose to be unreeled from the reel. The hose is inserted into a sewer manhole and into the laterals which require cleaning. Also on the truck is a tank having a large diameter vacuum hose attached thereto with the vacuum hose also supported by the boom. As debris is flushed from the laterals into a catch basin, the vacuum hose draws the debris into the tank. The Flynn system is satisfactory as long as the truck is aligned with the direction of payout and retrieval of the water hose. A cleaning apparatus mounted on a truck and having the suction hose mounted to a boom which can swivel horizontally and can be raised vertically is disclosed in the patent to Fisco, Jr., U.S. Pat. No. 4,199,837. In this device, the hose is mounted on a reel attached to the front of the truck which must be placed over the manhole to payout and retrieve the hose. Wurster, U.S. Pat. No. 4,322,868 teaches a truck having a rotatable boom which can be elevated which carries both the vacuum hose and the water hose. No details are shown for handling the reeling in and out of the water hose.

Since the water hose is often required to have a length of several hundred feet, it is essential that the cleaning system include a reel for the water hose which will permit the desired length to be available. For this size reel, it is desirable to rigidly mount the reel in a fixed orientation to the truck body. It is also desirable to utilize a boom which can be rotated almost 360 degrees to eliminate the requirement for exact placement of the truck relative to the manhole or the basin to be cleaned. It is also necessary or desirable for the water hose to be carried by the boom such that the vacuum hose and the water hose can be in close proximity. As will be understood in this arrangement, if the boom is rotated at an angle to the alignment of the water hose reel, none of the systems shown in the above noted references would permit the hose to be reeled out and retrieved since sharp bends would occur therein. This is particularly serious when the boom is rotated 180 degrees from alignment with the hose reel. The known reel systems also provide a reversible drive motor attached to the reel which requires that the motive power for both payout and retrieval be supplied from such drive. As will be seen, when sharp bends are produced in the water hose due to movement of the boom, the payout must be accomplished by pushing the free end of the hose which has proven unsatisfactory. Thus, there is a need for a hose reel system in which the hose can be quickly and easily payed-out and retrieved without regard to the angle between the hose direction and the plane of the hose reel.

SUMMARY OF THE INVENTION

The present invention provides a hose reel and mechanical hose handling system having a boom for supporting the hose which permits the hose reel to be fixed in one position yet allows the boom and hose to be rotated around the hose reel approximately 320 degrees horizontally and to be elevated vertically about 45 degrees. These functions are performed with or without the hose being pressurized and no effect is required on the part of the operator.

An exemplary embodiment of the invention includes two basic elements. First, a fixed reel is mounted on a sewer cleaning machine truck bed and which may have its plane of rotation aligned with the longitudinal axis of the truck. A set of fairlead sheaves is attached to the framework of the reel and the hose is passed therethrough. The second major element is a hose traction wheel mounted at the outer end of a boom which carries the vacuum hose. A second fairlead sheave is mounted adjacent the hose traction wheel.

Each of the fairlead sheaves includes two sheaves mounted such that the hose is captivated therebetween but can move easily as the sheaves rotate. Each pair of sheaves is mounted to a trunnion which permits the fairlead sheave assembly to have 360 degree rotation around the centerline of the hose.

The boom may be rotated horizontally and the hose reel fairlead sheaves will rotate to maintain the axis of the hose aligned with the boom arm to the payout end and aligned with the hose on the reel at the inlet end. Similarly, the hose traction wheel fairlead sheaves will rotate to maintain the hose axis aligned with the traction wheel as the boom is raised and lowered.

A drive motor, preferably of the hydraulic type, is used to rotate the reel only in the direction to reel in the hose. A slip clutch between the hydraulic motor and the hose reel permits the reel to turn in the payout direction to allow the hose to be pulled off of the reel. The traction wheel includes a similar hydraulic drive motor and slip clutch with the motor arranged to rotate the traction wheel in a direction to payout the water hose from the hose reel. A self-tailer is disposed in contact with the water hose as it passes over the reel to maintain tension and friction between the traction wheel and the hose. The slip clutch permits the traction wheel to free wheel whenever the reel motor is turning to retrieve the hose. As will now be recognized, the boom may be raised and rotated out of the plane of the hose reel yet the fairlead sheaves will maintain alignment of the hose to permit both payout and retrieval regardless of the boom position.

It is therefore a principal object of the invention to provide a hose reel system which will permit a heavy water hose to be paid out by means of a traction wheel and to permit the hose to be retrieved onto the reel by a motor attached to the reel.

It is another object of the invention to provide a hose reel system having a first fairlead sheave assembly attached adjacent to the hose reel and a second fairlead assembly attached adjacent to the traction wheel in which the fairlead assemblies maintain the hose aligned when the traction wheel is moved out of the plane of the hose reel.

It is still another object of the invention to provide a high pressure hose reel system adapted for mounting on a sewer and basin cleaner in which the hose reel is fixed and means are provided to payout and retrieve the hose from the end of a movable boom which may be rotated with respect to the hose reel and elevated with respect to the hose reel.

It is a further object of the invention to provide a hose reel system in which a drive motor is attached to the hose reel by a slip clutch which permits the hose reel to be rotated for retrieving the hose and to free wheel when the hose is being paid out, and a motor attached to a traction wheel by means of a clutch to permit the traction wheel to pay the hose out and to free wheel while the hose is being retrieved.

It is still a further object of the invention to provide a hose reel system for a fixed hose reel and having a set of fairlead assemblies which will maintain the hose normal to fairlead sheaves as the hose is moved out of the plane of the hose reel.

These and other advantages and objects of the invention will become apparent from the following detailed description when read in conjunction with the drawings.

BRIEF DESCRIPTION OF THE DRAWINGS

while

FIG. 6 is a cutaway perspective view of the hose payout friction wheel assembly at the end of the boom shown in FIG. 1; and FIG. 7 is a cross-sectional view of the friction wheel of FIG. 6 showing the motor drive and clutch assembly.

DETAILED DESCRIPTION OF THE PREFERRED EMBODIMENT

Figure 1:
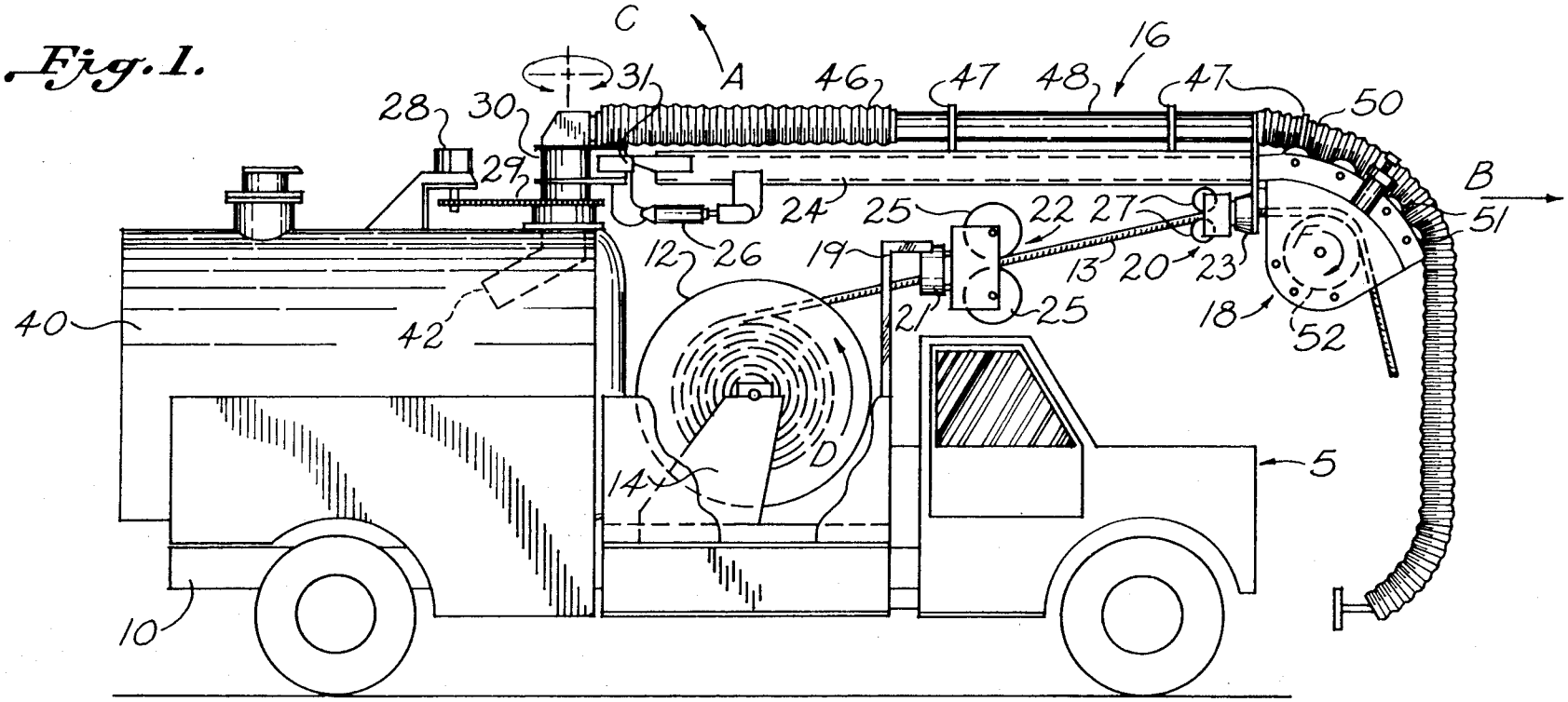
FIG. 1 is a side view of a sewer and catch basin cleaning truck showing the installation of the hose reel system of the invention thereon.

Referring to FIG. 1, the invention is illustrated as applied to a sewer and catch basin cleaner. It is to be understood that this application of the invention is for illustrative purposes only and the hose reel system of the invention may be applied to any system having a fixed hose reel and a payout element which is required to be non-aligned with the plane of the reel.

A truck shown generally at 5 has a truck bed 10 and includes a high pressure water hose reel 12 mounted to bed 10 on brackets 14. Also mounted on truck bed 10 but not shown are the necessary high pressure water pump and water reservoir which have an output connection to the inner end of the high pressure hose 13 on reel 12.

A tank 40 is provided on truck 5 to receive debris from the catch basin. As is known in the art, a suction hose 50 is required to be inserted into the catch basin of a sewer to be cleaned and is connected via a pipe 48 and flexible hose 46 to an inlet 42 for depositing debris in tank 40. Tank 40 is placed under vacuum by vacuum stem not shown. A stationary bracket 19 is mounted in front of reel 12 and supports a set of fairlead sheaves 22 consisting of sheaves 25 and rotatable bearing assembly 21. Water hose 13 is fed through sheaves 25 to a second set of fairlead sheaves 20 which are mounted at the end of boom 24. Fairlead sheave set 20 consists of a pair of sheaves 27 and a trunnion bearing assembly 23. Water hose 13 is fed through fairlead sheave set 20 and over hose traction reel 52 in traction assembly 18.

Boom 24 is extensible, consisting of a pair of telescoping elements which may be formed from square steel tubing or the like. Boom 24 is pivotally connected to a vertical post assembly 30 by pivot 31 and may be raised vertically to an angle of about 45 degrees by hydraulic actuator 26. Vertical column system 30 includes a rotary joint driven by a sprocket and chain assembly 29 from hydraulic motor 28. This system permits the boom 24 to be rotated in a horizontal plane for about 320 degrees. As will now be understood, the outer end of boom 24 may be conveniently positioned with respect to the system to be cleaned by vertical and horizontal adjustment of the boom position which eliminates the necessity for exact placement of truck 5 during a cleaning operation.

Hose traction wheel assembly 18 includes a set of rollers 51 which support suction hose 50. Suction hose 50 is connected to a pipe 48 which is connected by flexible hose section 46 to rotary joint and column system 30. Hose 46 and pipe 48 are maintained in place by brackets 47 which allow movement of pipe 48 when boom 24 is raised. When boom 24 is fully extended, the distal end of hose 50 will be supported by rollers 51 and extension suction hoses or pipes may be attached to extend hose 51.

Friction wheel 52 is powered by a hydraulic motor described hereinbelow to rotate in the direction shown by arrow F for paying out water hose 13 and includes a clutch assembly to permit free-wheeling of wheel 52 in the opposite direction of arrow F during retrieval. Hose reel 12 is also driven by a hydraulic motor system in combination with an overriding clutch assembly to be described below such that the drive motor will rotate reel 12 in the direction of arrow D to retrieve water hose 13 while the clutch assembly permits reel 12 to rotate freely in the opposite direction during payout. As will now be understood, hose 13 will be paid out from reel 12 by the rotation of traction wheel 52 which efficiently pulls hose 13 off of reel 12 and directs it downward as required. When it is desired to reel in hose 13, the motor drive for reel 12 is energized causing hose 13 to be pulled through the fairleads 22 and 20 and over traction wheel 52 which is free-wheeling.

Assuming that boom 24 is rotated horizontally as indicated by arrows C and raised vertically as indicated by arrow A, it will be noted that water hose 13 will no longer be in a line from reel 12 through traction wheel 52 since hose 13 will tend to bend horizontally at the outlet of fairlead 22 and will bend vertically at the inlet of fairlead 20. However, due to trunnion bearings 21 and 23, the fairlead assembly 22 will rotate to always maintain hose 13 normal to fairlead sheaves 25 and bearing 23 of fairlead assembly 20 will rotate to maintain hose 13 normal to sheaves 27. Thus, boom 24 may make an almost 180 degree rotation horizontally in either direction and over 45 degree movement in the vertical direction with hose 13 maintained in alignment with sheaves 25 and 27 such that hose 13 can be payed-out or recovered without kinking or bending. In addition, the hose is prevented from collapsing or kinking which would interfere with the water flow therethrough.

Figure 2:
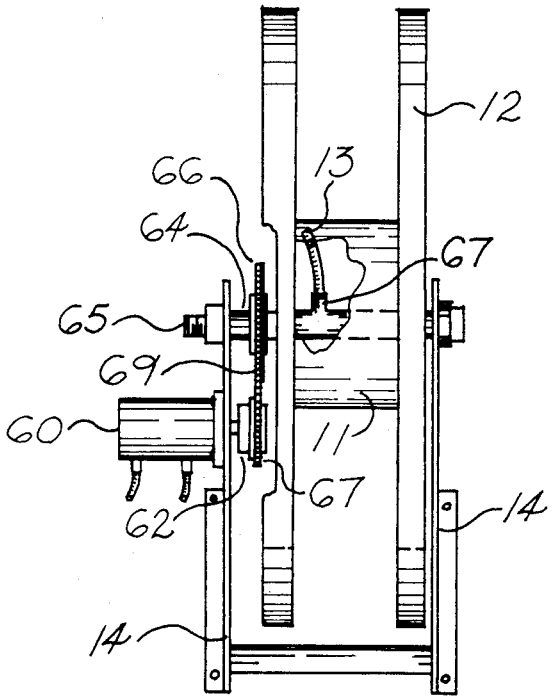
FIG. 2 is a top view of the hose reel of FIG. 1.

Turning now to FIG. 2, details of the drive system for reel 12 are shown in top view thereof. Reel 12 is supported by mounting brackets 14 and includes a central shaft 64 formed from a suitable diameter pipe. The outer end of pipe shaft 64 includes a threaded portion 65 for connection to a rotary joint to introduce water under pressure into reel 12. Pipe shaft 64 has an internal nipple 67 to which hose 13 connects. A central core 11 of reel 12 includes an opening therein for hose 13 which is wound on core 11. A length of hose 13 of 500 to 600 feet is typical for this exemplary application of the invention. Shaft 64 includes a sprocket 66 which is coupled to sprocket 67 by chain 69. Sprocket 67 is driven via an overrunning clutch 62 from hydraulic motor 60. A typical clutch 23 may be a Morse Type GFR 30. Motor 60 is controlled by the operator to run only when it is desired to reel in hose 13. During payout of hose 13, hydraulic motor 60 is inoperative and sprocket 67 freely turns due to the action of overrunning clutch 62.

Figure 4:
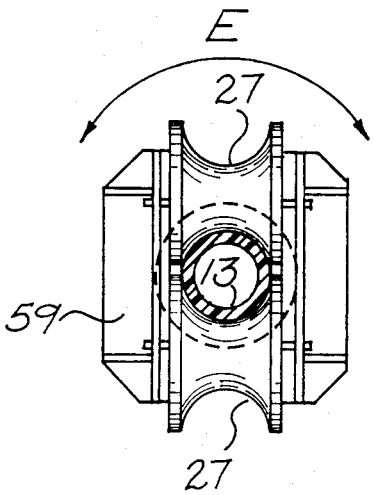
FIG. 4 is an end view of the sheaves of FIG. 3 showing the hose in place.
Figure 3:
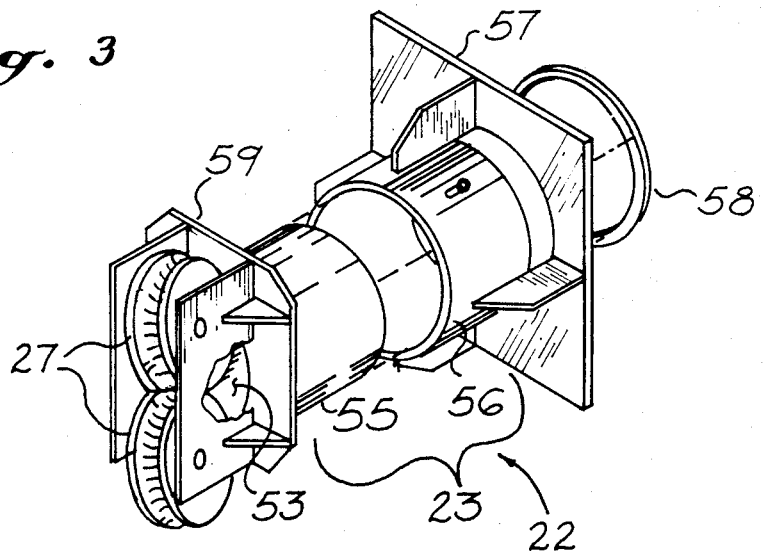
FIG. 3 is an exploded view of a fairlead sheave in accordance with the invention.

An exploded perspective view of fairlead assembly 22 is shown in FIG. 3. A body portion 57 which is attached to upright bracket 19 of FIG. 1 includes an outer trunnion bearing 56 in the form of a cylindrical sleeve. The sheave assembly includes mounting bracket 59 having a second cylindrical sleeve portion 55 of bearing assembly 23 shown in exploded view. As will be understood, when inner sleeve 55 is inserted in outer sleeve 56, a retaining ring 58 is welded to inner sleeve 55 thereby captivating the assembly. Grease may be injected between sleeves 55 and 56 to permit free rotation thereof, or alternatively, a roller or ball bearings may be utilized as will be obvious to those of skill in the art. Sheave bracket 59 supports a pair of sheaves 27 which are free to rotate. In FIG. 4, a view from the output end of fairlead assembly 22 is shown with hose 13 seen in cross-sectional view installed therein. It will be noted that the curvature of sheaves 27 is selected to form a snug fit with the outside diameter of hose 13. Therefore, forces on hose 13 which would tend to misalign the hose will be transferred to the rotatable trunnion bearing assembly forcing the fairlead assembly to always maintain the hose in alignment such that the plane of any bend in the hose due to movement of the boom 24 will be in the plane of the sheaves. As indicated by arrow E in FIG. 4, the sheave assembly is free to rotate 360 degrees.

Figures 5A, 5B, 5C:
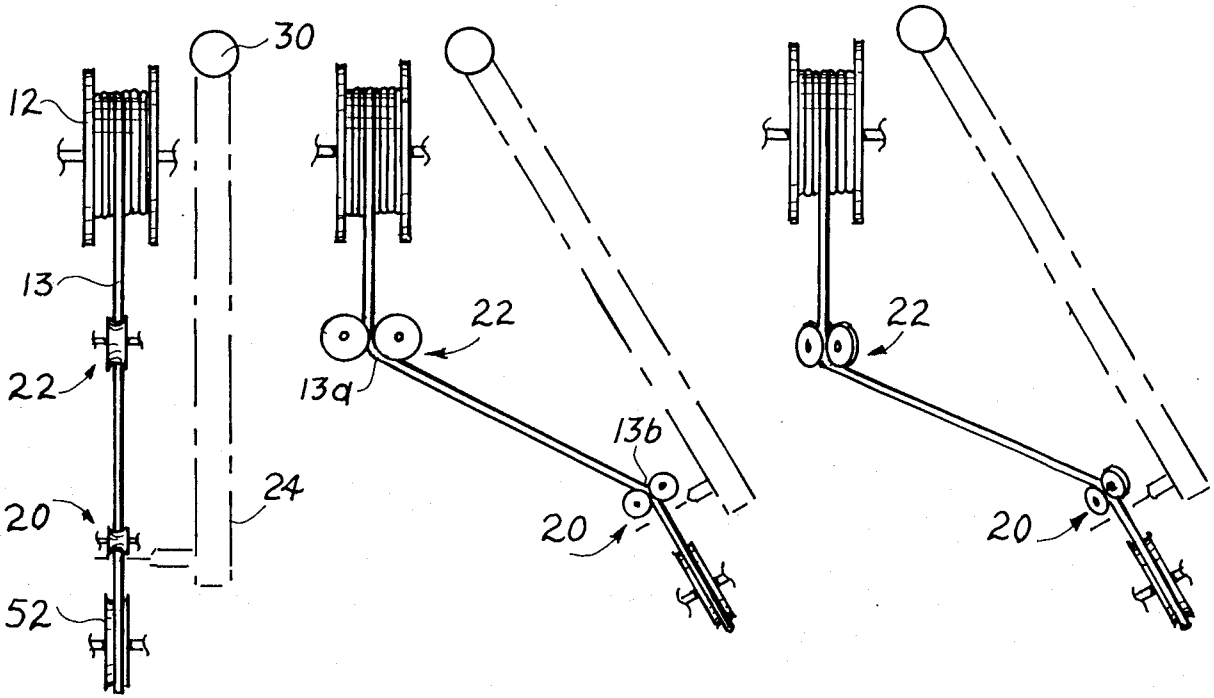
FIG. 5*a* is a top schematic view of the system of FIG. 1 showing fairing of the hose when the boom and traction wheel are in the plane of the reel.
FIG. 5*b* shows the boom rotated horizontally about 30 degrees.
FIG. 5*c* shows the boom rotated horizontally about 30 degrees and raised vertically.

The operation of fairlead assemblies 22 and 20 in fairing hose 13 for various positions of boom 24 may be best seen in FIGS. 5*a*–5*c*. In FIG. 5*a*, a schematic top view of the reel 12, boom 24 and traction wheel 52 of the system of FIG. 1 is indicated with various brackets and supports omitted for clarity. The sheaves only of fairlead assemblies 22 and 20 are shown to indicate the attitudes thereof. In FIG. 5*a*, boom 24 in phantom view is in the same plane as reel 12 which places the axes of reel 12 and traction wheel 52 parallel. When tension is placed on hose 13, either by hose traction wheel 52 pulling hose 13 outward or reel 12 pulling hose 13 inward, the forces on the fairlead sheaves will cause the assemblies 22 and 20 to rotate to place the axes of the sheaves parallel with reel 12 and traction wheel 52 axes.

In FIG. 5*b*, boom 24 has been rotated about column 30 horizontally about 30 degrees. As this rotation takes place, force is applied to fairlead assembly 22 by hose portion 13*a* causing it to rotate 90 degrees to the position shown. Similarly, hose portion 13*b* applies forces to fairlead assembly 20 rotating it 90 degrees as shown. The result is that the hose 13 is faired by the sheaves to the directions required while maintaining hose 13 aligned with reel 21 and aligned with traction wheel 52 thereby preventing kinking.

FIG. 5*c* represents the horizontal displacement of boom 24 shown in FIG. 5*b* with boom 24 raised vertically. The forces from hose 13 on fairlead assemblies 22 and 20 now cause rotation thereof at an angle between the 0 degrees of FIG. 5*a* and the 90 degrees of FIG. 5*b*.

As will now be apparent, boom 24 can be swung almost 180 degrees horizontally in each direction and about 45 degrees vertically with fairlead assemblies automatically adjusting to fair hose 13 such that it may be payed out and retrieved with no kinking or bending.

Details of the water hose traction wheel assembly 18 are shown in FIGS. 6 and 7. In the cutaway perspective view of FIG. 6, traction wheel 55 is seen mounted in a housing 70. Housing 70 is attached to a mounting plate 71 which is welded to the outer end of the inner portion of extensible boom 24. As will be noted, housing 70 includes a water hose inlet opening 75 and outlet opening 77. Fairlead assembly 20 is mounted to mounting plate 71 with the sheave assembly 27 free to rotate as indicated by arrow G. Thus, hose 13 is fed through fairlead assembly 20 and opening 75, around friction wheel 52, and out through opening 77. To provide friction between hose 13 and traction wheel 52, a self-tailer 74 is provided over approximately a 90 degree arc. Self-tailer 74 includes a plurality of rollers 75 and is spring loaded by spring 73 in assembly 72. The tension of spring 73 may be adjusted with adjusting screw 76. Adjacent to housing 70 is a roller assembly 79 attached to mounting plate 71 immediately adjacent boom 24. Rollers 51 in assembly 79 are shaped to fit the contour of suction hose 50 to guide the suction hose 50 when boom 24 is extended and retracted.

In FIG. 76, a cross-sectional view of housing 70 is shown which provides details of the drive system for traction wheel 52. Wheel 52 is shown in cross-sectional view and the outer periphery 85 thereof may be seen to be shaped to fit the diameter of hose 13 and is preferably coated with neoprene or other friction type material. Details of the spring loaded self-tailer 74 may also be noted which assists in maintaining friction between hose 13 and wheel 52 and also permits hose 13 to include hose couplings since the self-tailer 74 will ride over such couplings. A hydraulic drive motor 80 is attached to a mounting bracket 81 and coupled by coupling 82 to an overrunning clutch 82 connected to traction wheel 52. Hydraulic motor 80 is energized by the operator when it is desired to payout water hose 13 which causes traction wheel 52 to rotate in the direction shown by arrow F. As previously discussed, when hose 13 is to be retracted, it is pulled by reel 12 and traction wheel 52 rotates freely through the action of clutch 83.

As will now be understood, a hose reel system has been disclosed in which a reel for a hose is mounted in a fixed location and the hose can be payed out and retrieved without regard to the angle of the hose with respect to the plane of the reel. The invention has particular application to use on trucks and the like having a movable boom from which a hose is to be payed out from a fixed reel. Although the preferred embodiment has been disclosed with reference to a sewer and catch basin cleaner, the invention is not so limited. Many variations in construction will be obvious. For example, electric or pneumatic drive motors may be used for the reel and traction wheel. This and other modifications are deemed to fall within the spirit and scope of the invention.

I claim:

1. A hose reel system comprising:

a fixed hose reel for storing a hose;

first drive means attached to said hose reel for rotating said hose reel in a direction to wind a hose onto said reel;

a first fairlead sheave assembly mounted adjacent to said hose reel and having a first pair of rotatable sheaves for guiding a hose, said first fairlead sheave assembly having a trunnion bearing permitting said assembly to rotate so as to maintain a hose in a plane perpendicular to the axes of said sheaves;

a hose traction wheel movably disposed with respect to said fixed hose reel, said traction wheel adapted to grip the hose from said reel for paying out such hose from said reel;

second drive means attached to said hose traction wheel for rotating said wheel in the direction to payout a hose from said reel; and a second fairlead sheave assembly mounted adjacent to said hose traction wheel and having a second pair of rotatable sheaves for guiding a hose to said traction wheel, said second fairlead sheave assembly having a trunnion bearing permitting said second assembly to rotate to maintain a hose in a plane perpendicular to the axes of said sheaves.

2. The system as defined in claim 1 in which:

said first drive means includes a drive motor coupled to said wheel by a clutch permitting said hose reel to rotate freely in a direction to payout a hose; and said second drive means includes a motor attached to said traction wheel by means of a clutch for permitting said traction wheel to rotate freely during winding of a hose onto said reel.

3. The system as defined in claim 2 in which each of said motors are hydraulically operated.

4. The system as defined in claim 1 in which said hose traction wheel includes a self-tailer for increasing friction between a hose and said traction wheel.

5. The system as defined in claim 4 in which said self-tailer includes a spring and adjustment means for controlling the friction between a hose and said traction wheel.

6. In a system having a source of water under pressure and a vertically and horizontally movable boom, a hose reel system comprising:

a hose reel mounted to rotate about a first axis, said reel being fixed relative to said movable boom;

a hose attached to said source of water and wound onto said hose reel;

a first fairlead assembly mounted adjacent to said hose reel for guiding said hose from and to said reel, said first assembly rotatable with respect to said reel to maintain said hose perpendicular to the axis of said reel during payout and rewind of said hose;

a hose traction wheel mounted to rotate about a second axis and being movable with said boom and in contact with said hose;

a first drive motor operatively connected to said hose reel for rewinding said hose onto said reel;

a second drive motor operatively connected to said traction wheel for paying out said hose from said reel; and a second fairlead assembly mounted to said boom adjacent to said traction wheel for guiding said hose from and to said traction wheel, said second assembly rotatable with respect to said traction wheel to maintain said hose perpendicular to the axis of said traction wheel during payout and rewind of said hose.

7. The system as defined in claim 6 in which said first drive motor is connected to said hose reel by means of an overrunning clutch to permit said hose reel to freewheel when said hose is being payed out.

8. The system as defined in claim 6 in which said second drive motor is connected to said traction wheel by means of an overrunning clutch for permitting said traction wheel to freewheel when said hose is being rewound onto said hose reel.

9. The system as defined in claim 6 in which said first and said fairlead assemblies each include:

a sheave mounting bracket;

a pair of sheaves mounted in said sheave mounting bracket such that said hose is gripped between the peripheries of said pair of sheaves;

a second assembly mounting bracket for mounting said first fairlead assembly adjacent to said hose reel; and a trunnion bearing connected between said sheave mounting bracket and said second assembly mounting bracket to permit said sheave mounting bracket to be rotated about an axis concentric with said hose.

10. In a sewer and catch basin cleaner disposed on a vehicle and having an extensible boom rotatable horizontally and vertically with respect to said vehicle, a debris chamber, a vacuum system and vacuum hose, said vacuum hose carried by said boom, and a source of water under pressure, a water hose system comprising:

a hose attached to said source of water under pressure;

a hose reel having said hose wound upon said reel;

a hose reel bracket attached to said vehicle, said hose reel supported about a fixed axis by said bracket;

a first drive motor disposed on said hose reel bracket and connected to said hose reel by a first overrunning clutch, said first drive motor for rotating said reel in a direction to wind said hose onto said reel, said first clutch permitting said reel to turn freely in a direction to payout said hose from said reel;

a first fairlead assembly attached to said vehicle adjacent to said hose reel, said first fairlead assembly having a first pair of sheaves mounted such that the peripheries thereof cooperate to grip said hose along a first axis perpendicular to the axis of said hose reel, said first pair of sheaves mounted to freely rotate about said first axis wherein said hose from said reel is passed through said first fairlead assembly;

a hose traction wheel assembly mounted to rotate about an axis on a distal end of said boom and movable therewith, said wheel assembly having a hose traction wheel for paying out said hose;

a second fairlead assembly attached to said distal end of said boom adjacent said hose traction wheel assembly, said second fairlead assembly having a second pair of sheaves mounted such that the peripheries thereof cooperate to grip said hose along a second axis perpendicular to the axis of said hose traction wheel, said second pair of sheaves mounted to freely rotate about said second axis, wherein said hose from said first fairlead assembly is passed through said second fairlead assembly and over said hose traction wheel; and a second drive motor disposed on said hose traction wheel assembly and connected to said hose traction wheel by an overrunning clutch, said second drive motor rotating in a direction to cause said hose traction wheel to pull said hose from said hose reel via said first and second fairlead assemblies, said second clutch permitting said hose traction wheel to freely rotate in a direction to rewind said hose onto said reel.

11. The system as defined in claim 10 in which said hose traction wheel assembly includes:

a self-tailer having a plurality of arcuate rollers and disposed to captivate said hose between said rollers and the periphery of said hose traction wheel;

spring means for biasing said rollers against said hose and said periphery of said hose traction wheel; and adjustment means for adjusting the tension of said spring.

* * * * *